US005504392A

United States Patent [19]

Natour et al.

[11] Patent Number: 5,504,392

[45] Date of Patent: Apr. 2, 1996

[54] HIGH PRESSURE METAL HALIDE LAMP

[75] Inventors: Ghaleb Natour, Aachen; Robert P. Scholl, Roetgen, both of Germany

[73] Assignee: U.S. Philips Corporation, New York, N.Y.

[21] Appl. No.: 249,418

[22] Filed: May 26, 1994

[30] Foreign Application Priority Data

Jun. 1, 1993 [EP] European Pat. Off. ..... 93201556

[51] Int. Cl.[6] ..... H01J 61/18

[52] U.S. Cl. ..... 313/570; 313/641; 313/642

[58] Field of Search ..... 313/570, 638, 313/641, 640, 642

[56] References Cited

U.S. PATENT DOCUMENTS 5,323,085 7/1994 Genz ..... 313/641 X 5,382,873 1/1995 Scholl et al. ..... 313/570

FOREIGN PATENT DOCUMENTS 0492205 7/1992 European Pat. Off. ..... H01J 61/12

2139078 3/1972 Germany ..... 313/640

*Primary Examiner*—Sandra L. O'Shea
*Assistant Examiner*—Ashok Patel
*Attorney, Agent, or Firm*—Brian J. Wieghaus

[57] ABSTRACT

The high pressure metal halide lamp has in a light transmitting discharge vessel discharge electrodes and a filling made of a rare gas, a buffer gas and at least one halide chosen from hafnium and zirconium bromide and chloride. The filling also includes a metal chosen from tin, tantalum and antimony in elementary form and is free from iodine in an amount exceeding 0.5 μmol/cm$^3$ discharge space. The lamp has considerably improved light generating properties.

17 Claims, 1 Drawing Sheet

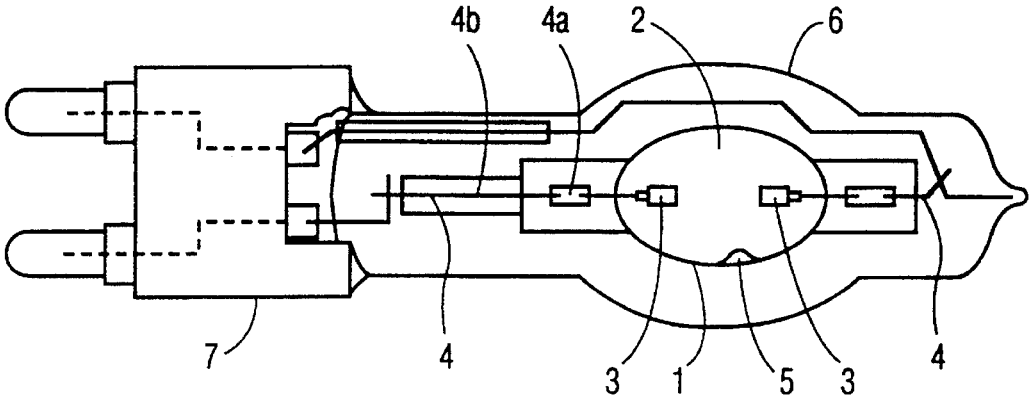
4b
4a
2
6
7
4
3
1
5
3
4

HIGH PRESSURE METAL HALIDE LAMP

BACKGROUND OF THE INVENTION

The invention relates to a high pressure metal halide lamp comprising:

a light transmitting discharge vessel, enclosing a discharge space, sealed in a gas-tight manner, in which tungsten electrodes are disposed, which are connected to current conductors which extend to the exterior;

a filling in the discharge vessel comprising a rare gas, a buffer gas and at least one halide chosen from the halides of hafnium and zirconium.

Such a high pressure metal halide lamp is known from EP-0 492 205-A2, which corresponds to U.S. Pat. No. 5,323,085.

The known lamp contains a mixture of halides of one of the metals hafnium and zirconium, i.e. a mixture of the iodide and the bromide, particularly in a mol ratio of 0.2 to 5.

Although the known lamp was destined to yield light having a colour temperature of between 4000 and 9000 K., the lowest colour temperature described is 5200 K. and the highest 6200 K. The lamp is furthermore destined to have, and has indeed, a high colour rendering index Ra and a good $R_9$ index value, indicating a good strong-red rendering.

The known lamp has a relatively low luminous efficacy of about 70 lm/W at a relatively high power consumption of 400 W, although it is generally known that the luminous efficacy of a discharge lamp is generally high at relatively high power consumption.

The life of the known lamp is relatively short, a few hundreds of hours.

The known lamp comprises cesium. Cesium is known to lower the reignition voltage of discharge lamps, without having a substantial influence on the light generated. The lamp may furthermore comprise additives like rare earth metals, cobalt and/or nickel in order to improve the quality of the light generated. These additives are shown, however, to have a slight influence, only. Other additives investigated are said to have no favourable effect.

In the non-prepublished European patent application 92 20 36 50.4 (which corresponds to U.S. Pat. No. 5,382,873) high pressure discharge lamps are described with or without internal electrodes. The lamps comprise an halide of hafnium and/or zirconium as the light generating species. During operation of the lamps the halide is evaporated and decomposed in a high temperature region of the discharge. A supersaturated metal vapour is then formed from which metal particles originate by condensation. These particles generate light by incandescence.

The electroded lamps of this non-prepublished application have a long life as compared to electroded discharge lamps having a volatile tungsten compound as the light generating species which generates incandescent tungsten clusters after having been decomposed: a few hours as compared to a few minutes.

SUMMARY OF THE INVENTION

It is an object of the invention to provide a high-pressure discharge lamp of the kind described in the opening paragraph which has improved light generating properties.

According to the invention this object is achieved in that the said at least one halide is chosen from hafnium bromide, hafnium chloride, zirconium bromide and zirconium chloride, the filling contains a metal selected from tin, tantalum and antimony in elementary form and is free from iodine in an amount exceeding 0.5 μmol I/cm$^3$ discharge space. The iodine need not be present, but if present, does not exceed 0.5 μmol/cm$^3$.

The group of halides from which the said at least one halide is chosen, is herein after also referred to as "the group defined".

The invention is amongst others based on the recognition that iodine has a detrimental influence on the life of the lamp of the kind concerned. Iodine when present in a substantial amount gives rise to an early fusing of the electrodes. This causes blackening of the discharge vessel, and also causes the electrodes to melt away and the discharge arc to touch the discharge vessel and thereby to destroy it. It is therefore best if the filling is free from iodine in whatever form: in elementary form or as an iodide. However, minor amounts of less than 0.5 μmol I/cm$^3$ discharge space can be allowed in most events, because generally such minor amounts hardly or not do limit the life of the lamp.

The lamp of the invention has a high luminous efficacy, particularly with hafnium bromide and/or hafnium chloride in the filling. Preference is given to bromides, particularly to hafnium bromide as the sole halide, selected from the group of halides defined, because of the interestingly low colour temperature that can be achieved in combination with a high general colour rendering, high $Ra_8$ value, and good to very good strong-red rendering, $R_9$ value.

The elements tin, tantalum and antimony contribute to the relatively long life of the lamp. Quite surprisingly, tin in a lamp containing a bromide, e.g. hafnium bromide, as the, or as one of the, selected halides, favourably influences the efficacy, as well as the general colour rendering and particularly the strong-red rendering. The colour point in the colour triangle is shifted to the black body locus or to the proximity thereof. Moreover, tin in a lamp reduces the UV output considerably to a low percentage of the power consumed. These influences are observed already as soon as the lamp, being operated for the first time after its manufacture, has obtained steady operational conditions. These influences are apparent when the lamp is compared with a lamp without tin, but for the rest being identical to the lamp of the invention. The molar ratio of the total amount of these elements in the filling to the total amount of halides of the group defined generally is between 0.3 and 10, favourably between 1 and 3.

In a favourable embodiment the lamp of the invention has in its filling an additional amount of tin bromide, e.g. in a molar ratio to the total amount of halides of the group defined of up to 2, e.g. of up to 1. The presence of additional tin bromide lowers the colour temperature.

In stead of one halide of the group defined, two or more halides belonging to said group may be present. The total amount of halides of the group defined typically is in the range of 0.5 μmol/cm$^3$ to 100 μmol/cm$^3$, more particularly in the range of 2 μmol/cm$^3$ to 20 μmol/cm$^3$. These figures correspond to a vapour pressure of 100 mbar, 20 bar, 0.4 bar and 4 bar respectively, at a mean plasma temperature of 2500 K. Below the said broad range the efficacy of the lamp is poor and the colour rendering as well. Experimental data suggest that optimum properties are within the narrow range. No advantages of further increased amounts above the broad range are to be expected.

As a buffer gas, mercury may be present in the filling. Alternatively or in addition, however, a rare gas, for example, xenon may be present for that purpose. This has advantages from an environmental point of view. The rare gas then functions as a buffer gas and as a starting gas as well. The molar ratio of the amount of buffer gas to the total amount of halides of the group defined generally is between 2 and 40, favourably between 5 and 30, more particularly between 10 and 15, for the purpose of a high efficacy.

It is a favourable aspect of the lamp of the invention that the halides of the group defined are completely evaporated during operation. Of these halides hafnium bromide has the highest boiling point, only 420° C. As a consequence thereof the lamp may be operated in any position without any substantial alteration of the colour temperature. Operation of the lamp at a power lower than the design power is possible without large changes in the colour temperature.

These and other details and aspects of the lamp of the invention and embodiments thereof will be described in the examples and shown in the drawing.

BRIEF DESCRIPTION OF THE DRAWINGS

An embodiment of the lamp of the invention is shown in the drawing in side elevation.

DESCRIPTION OF THE PREFERRED EMBODIMENTS

In the drawing the high pressure metal halide lamp comprises a light transmitting discharge vessel 1, in the drawing of quartz glass, but alternatively of sintered alumina, for instance, which encloses a discharge space 2. The discharge vessel is sealed in a gas-tight manner. Tungsten electrodes 3 which are connected to current conductors 4 which extend to the exterior, are disposed in the discharge vessel. A filling 5 is present which comprises a rare gas, a buffer gas and at least one halide chosen from the halides of hafnium and zirconium. In the drawing the electrodes are welded to a respective molybdenum foil 4*a*, which is welded to a molybdenum wire 4*b*. The lamp shown is mounted in an outer envelope 6, e.g. of hard glass, which is secured in a lamp base 7. Alternatively, however, the lamp may be operated without an outer envelope.

The said at least one halide is chosen from hafnium bromide, hafnium chloride, zirconium bromide and zirconium chloride, the filling contains a metal selected from tin, tantalum and antimony in elementary form and is free from iodine in an amount exceeding 0.5 μmol I/cm$^3$ discharge space.

In an experiment several examples (E) of the lamp of the invention were compared with lamps of the kind known from the cited EP-0 492 205-A2 (O) or described in the afore cited non-prepublished EP application 92 20 36 50.4 (P).

TABLE 1a

| Lamp | Hg | $HfBr_4$ | Sn | $HfI_4$ | mol I/ mol Br | μmol Hf/ cm$^3$ | mol Hg/ mol Hf | mol Sn/ mol Hf |
|---|---|---|---|---|---|---|---|---|
| $O_1$ | 10 | 1.2 | | 1.7 | 1.0 | 6.9 | | |
| $P_1$ | 10 | 2.4 | | | | 6.9 | | |
| $P_2$ | 14 | 2.4 | | | | 6.9 | | |
| $P_3$ | 32 | 2.4 | | | | 6.9 | | |
| $E_1$ | 12 | 2.4 | 0.3 | | | 6.9 | 12.4 | 0.5 |
| $E_2$ | 12 | 2.4 | 1.2 | | | 6.9 | 12.4 | 2.1 |

TABLE 1b

| Lamp | Power (W) | η (lm/W) | $Ra_8$ | $R_9$ | Tc (K) | life (hrs) |
|---|---|---|---|---|---|---|
| $O_1$ | 250 | 74 | 93 | 84 | 5200 | 100 |
| $P_1$ | 269 | 94 | 94 | 84 | 5200 | 6 |
| $P_2$ | 300 | 92 | 96 | 92 | 5230 | 6 |
| $P_3$ | 290 | 87 | 93 | 73 | 5351 | 6 |
| $E_1$ | 268 | 95 | 97 | 98 | 5000 | 130 |
| $E_2$ | 263 | 95 | 97 | 97 | 4925 | 350 |

The discharge vessel (DV1) had a volume of 0.7 ml and a largest inner diameter transverse to the discharge path of 0.95 cm, the electrode distance being 0.75 cm in all cases.

Apart from 1333 Pa argon the lamps contained the components (mg) represented in Table 1*a*. The test results are represented in Table 1*b*.

From these data of fully comparable lamps it is apparent that the lamp of the invention has a longer to considerably longer life than the prior art lamps. Also, his efficacy, and general and strong-red colour rendering are higher to an important extent. It is favourable that the colour temperature of the examples (E) shown is lower than that of the prior an (O, P) lamps. The colour temperatures are lower than the colour temperature of any lamp described in the cited EP-0 492 205-A2.

Other examples of the lamp of the invention were made using a discharge vessel (DV2) having a volume of 1 cm$^3$ and a largest inner diameter transverse to the discharge path of 1.1 cm, the electrode distance being 0.6 cm. The lamps contained 1333 Pa argon and the constituents (mg) of Table 2*a*. The properties of the lamps are represented in Table 2*b*.

TABLE 2a

| Lamp | Hg | $HfBr_4$ | Sn | μmol Hf/cm$^3$ | mol Hg/ mol Hf | mol Sn/ mol Hf |
|---|---|---|---|---|---|---|
| $E_3$ | 27 | 3.5 | 0.4 | 7.0 | 19.3 | 0.5 |
| $E_4$ | 27 | 4.8 | 1.2 | 9.6 | 14.1 | 1.1 |

TABLE 2b

| Lamp | Power (W) | η (lm/W) | $Ra_8$ | $R_9$ | Tc (K) | life (hrs) |
|---|---|---|---|---|---|---|
| $E_3$ | 266 | 84 | 96 | 75 | 4410 | 350 |
| $E_4$ | 232 | 84 | 98 | 86 | 4680 | 2100 |

From Table 2*b* it is apparent that the lamps as compared to the known lamp $O_1$ have a high efficacy, a high general colour rendering index, a good strong-red rendering, a color temperature lower by 500 to 800 K. and a much longer life.

TABLE 3a

| Lamp | Hg | $HfBr_4$ | Sn | μmol Hf/cm$^3$ | mol Hg/ mol Hf | mol Sn/ mol Hf |
|---|---|---|---|---|---|---|
| $E_5$ | 3.4 | 1.0 | 0.3 | 10.0 | 8.5 | 1.3 |
| $E_6$ | 3.4 | 0.7 | 0.4 | 7.0 | 12.1 | 2.4 |
| $E_7$ | 8 | 1.5 | 0.4 | 4.3 | 13.3 | 1.1 |
| $E_8$ | 12 | 2.4 | 1.2 | 6.9 | 12.4 | 2.1 |
| $E_9$* | 4.5 | 2.4 | 0.4 | 6.9 | 10.6** | 0.7 |
| $E_{10}$* | — | 2.4 | 0.4 | 6.9 | 5.9** | 0.7 |
| $E_{11}$ | 12 | 1.5^ | 1.2 | 6.7 | 12.8 | 2.1 |
| $E_{12}$+ | 12 | 2.4 | 1.2 | 6.9 | 12.4 | 2.1++ |
| $E_{13}$ | 35 | 3.44 | 1.2 | 6.9 | 25.4 | 1.5 |
| $E_{14}$ | 27 | 4.8 | 1.2 | 9.6 | 14.1 | 1.1 |
| $E_{15}$ | 14 | 3.4 | 1.2 | 6.8 | 10.3 | 1.5 |
| $E_{16}$ | 20 | 3.4 | 1.2 | 7.6 | 14.6 | 1.5 |
| $E_{17}$ | 20 | 3.4 | 1.2 | 5.7 | 14.9 | 1.5 |
| $E_{18}$ | 12 | 1.1# | 1.2 | 6.7## | 12.8## | 2.1## |

TABLE 3a-continued

| Lamp | Hg | $HfBr_4$ | Sn | μmol Hf/cm³ | mol Hg/ mol Hf | mol Sn/ mol Hf |
|---|---|---|---|---|---|---|
| $E_{27}$ | 4 | 1 | 0.3 | 2.8 | 10 | 1.2 |
| $E_{28}$ | 12 | 2⁻ | 1.2 | 6.8## | 12## | 2## |
| $E_{29}$ | 12 | 2.4 | 0.3 | 6.8 | 12.5 | 0.75 |

*plus 1 bar Xe, without Ar
^$HfCl_4$ in stead of the bromide
++ excl. $SnBr_2$
Zr in stead of Hf
**total mol buffer gas
+plus 1.5 mg $SnBr_2$
#$ZrCl_4$ in stead of $HfBr_4$
⁻$ZrBr_4$ in stead of $HfBr_4$ Other examples of the lamp of the invention were made using the discharge vessels DV1 and DV2, as well as a discharge vessel DV3 having a volume of 0.2 cm³, a largest diameter transverse to the discharge path of 0.7 cm and an electrode distance of 0.6 cm, a discharge vessel DV4 having a volume of 0.9 cm³, a largest diameter transverse to the discharge path of 0.95 cm and an electrode distance of 0.5 cm, and a discharge vessel DV5 having a volume of 1.2 cm³, a largest diameter transverse to the discharge path of 1.2 cm and an electrode distance of 0.5 cm, as well. The fillings of these lamps contained apart from 13.3 Pa Argon the constituents (mg) of Table 3*a*. The results of tests with these lamps are represented in Table 3*b*.

TABLE 3b

| Lamp | DV | Power (W) | η (lm/W) | $Ra_8$ | $R_9$ | TC (K) |
|---|---|---|---|---|---|---|
| $E_5$ | 3 | 200 | 94 | 99.2 | 96.7 | 5720 |
| $E_6$ | 3 | 180 | 87 | 98 | 94 | 6200 |
| $E_7$ | 1 | 322 | 95 | 98 | 98 | 5410 |
| $E_8$ | 1 | 300 | 97 | 97 | 98 | 4875 |
| $E_9$ | 1 | 261 | 95 | 94 | 85 | 5270 |
| $E_{10}$ | 1 | 268 | 85 | 97 | 96 | 5350 |
| $E_{11}$ | 1 | 270 | 90 | 92 | 53 | 6710 |
| $E_{12}$ | 1 | 260 | 72 | 97 | 87 | 3960 |
| $E_{13}$ | 2 | 270 | 87 | 98 | 81 | 4560 |
| $E_{14}$ | 2 | 233 | 85 | 98 | 84 | 4290 |
| $E_{15}$ | 2 | 250 | 83 | 98 | 86 | 4330 |
| $E_{16}$ | 4 | 270 | 86 | 98 | 80 | 4280 |
| $E_{17}$ | 5 | 220 | 83 | 98 | 92 | 4570 |
| $E_{18}$ | 1 | 266 | 80 | 96 | 78 | 7664 |
| $E_{27}$ | 1 | 320 | 84 | 98 | 97 | 6100 |
| $E_{28}$ | 1 | 296 | 77 | 96 | 93 | 5030 |
| $E_{29}$ | 1 | 280 | 94 | 98 | 88 | 4400 |

From this Table 3*b* the high luminous efficacy of the lamp of the invention is apparent, also taken into account the relatively low power consumption of the Examples given. The Examples show a very high to almost excellent general colour rendering and a good to very high strong-red rendering. It is remarkable that the colour temperatures in this Table cover a very broad range from 3960 to 7664 K. This range is much broader than disclosed in the said EP-0 492 205-A2, which only goes from 5200 to 6200 K., and which is not enlarged by the addition of other active components like dysprosium, cobalt and gadolinium to the filling.

The lamp $E_5$ was operated at several powers. Its properties are shown in Table 4.

TABLE 4

| Power (W) | 137 | 163 | 180 | 200 | 225 | 245 |
|---|---|---|---|---|---|---|
| η (lm/W) | 87 | 90 | 91 | 94 | 94 | 93 |

TABLE 4-continued

| Power (W) | 137 | 163 | 180 | 200 | 225 | 245 |
|---|---|---|---|---|---|---|
| Tc (K) | 6300 | 6100 | 5700 | 5720 | 5820 | 5990 |

From this Table it is apparent that the lamp is excellently dimmable, without major influences on the colour temperature or the efficacy. The same appears from Table 5 which contains data of another Example, $E_{19}$, having discharge vessel DV2, and 27 mg Hg, 3.5 mg $HfBr_4$, 1.2 mg Sn and 1333 Pa argon as its filling.

TABLE 5

| Power (W) | 240 | 260 | 280 | 300 | 320 | 345 |
|---|---|---|---|---|---|---|
| η (lm/W) | 83 | 84 | 84 | 83 | 85 | 85 |
| Tc (K) | 4496 | 4445 | 4427 | 4360 | 4340 | 4310 |

The influence of the ratio buffer gas/halide of the group defined (mol/mol) is illustrated by means of an embodiment of the lamp of the invention in which a discharge vessel DV1 with a filling of 2.4 mg $HfBr_4$, 0.4 mg Sn, 1333 Pa Ar and varying amounts of Hg was used. The efficacy and the colour rendering of these Examples ($E_{20}$–$E_{26}$) is given in Table 6 and compared with a similar lamp (Ref) not according to the invention without buffer gas.

TABLE 6

| Lamp | Ref | $E_{20}$ | $E_{21}$ | $E_{22}$ | $E_{23}$ | $E_{24}$ | $E_{25}$ | $E_{26}$ |
|---|---|---|---|---|---|---|---|---|
| mol Hg/ mol Hf | 0 | 2 | 4 | 6 | 10 | 12 | 14 | 32 |
| Ra | 82 | 87 | 89 | 92 | 96 | 97 | 97 | 93 |
| η (lm/W) | 47 | 75 | 85 | 90 | 94 | 95 | 94 | 87 |

It is seen that the buffer gas in a broad range of ratios increases the colour rendering and the efficacy, optimum values being obtained in the range of about 10 to about 15.

The presence of cesium halide in the lamp of the invention favours the reingnition of the lamp which is apparent from Table 7 and lowers the colour temperature. This effect is, however, at the cost of a small loss in efficacy and in colour rendering. The Table compares Example $E_1$ without cesium halide with Example $E_{27}$ being identical to $E_1$, but containing 0.6 mg CsBr. The ignition voltage is 800 V in both cases.

TABLE 7

| | η (lm/W) | Ra | $R_9$ | Tc (K) | reign (V) |
|---|---|---|---|---|---|
| $E_1$ | 95 | 97 | 98 | 5200 | 650 |
| $E_{27}$ | 93.5 | 93 | 90 | 5100 | 550 |

The favourably low UV output of the lamp of the invention becomes apparent when a lamp having discharge vessel DVI and a filling consisting of 2.4 mg $HfBr_4$, 1333 Pa Ar: UV-A=3.5%; UV-B=0.1%, is compared with a similar lamp which is according to the invention and contains in addition 1.2 mg Sn: UV-A=0.8%, UV-B=0.0%.

Another comparison is of a lamp having discharge vessel DV2 and 3.4 mg $HfBr_4$, 27 mg Hg, 1333 Pa Ar: UV-A 3.0%; UV-B 0.0%, with a similar lamp which is according to the invention and contains additionally 1.2 mg Sn: UV-A=0.4% and UV-B=0.0% of the power consumed.

We claim:

1. A high pressure metal halide lamp, comprising:

a light transmitting discharge vessel, enclosing a discharge space, and sealed in a gas-tight manner, the discharge vessel including tungsten electrodes disposed in the discharge space, and current conductors connected to the discharge electrode which extend to the exterior;

a filling in the discharge vessel comprising a rare gas, a buffer gas, a halide selected from the group consisting of hafnium bromide, hafnium chloride, zirconium bromide and zirconium chloride, and a metal selected from the group consisting of tin, tantalum and antimony in elementary form, said filling being free from iodine in an amount exceeding 0.5 μmol I/cm$^3$ discharge space.

2. A high pressure metal halide lamp as claimed in claim 1, characterized in that the at least one halide is selected from the group consisting of hafnium bromide and hafnium chloride.

3. A high pressure metal halide lamp as claimed in claim 2, characterized in that hafnium bromide is the selected halide.

4. A high pressure metal halide lamp as claimed in claim 3, characterized in that tin is the metal selected.

5. A high pressure metal halide lamp as claimed in claim 1, characterized in that the molar ratio of the amount of buffer gas to the total amount of bromide and chloride of hafnium and zirconium is in the range of 2 to 40.

6. A high pressure metal halide lamp as claimed in claim 5, characterized in that the said molar ratio is between 5 and 30.

7. A high pressure metal halide lamp as claimed in claim 6, characterized in that the buffer gas is a rare gas.

8. A high pressure metal halide lamp as claimed in claim 7, characterized in that the filling comprises an addition of tin bromide.

9. A high pressure metal halide lamp as claimed in claim 2, characterized in that tin is the metal selected.

10. A high pressure metal halide lamp as claimed in claim 5, characterized in that the buffer gas is a rare gas.

11. A high pressure metal halide lamp as claimed in claim 5, characterized in that the filing comprises an addition of tin bromide.

12. A high pressure metal halide lamp as claimed in claim 1, characterized in that the filing comprises an addition of tin bromide.

13. A metal halide lamp, comprising:

a discharge vessel enclosing a discharge space and being sealed in a gas-tight manner, said discharge vessel including a pair of discharge electrodes within said discharge space between which a gas discharge is maintained during lamp operation and means for connecting said discharge electrodes to a source of electric potential outside of said discharge vessel; and a filling in said discharge vessel, said filling comprising a rare gas, a halide selected from the group consisting of hafnium bromide, hafnium chloride, zirconium bromide and zirconium chloride, and a metal selected from the group consisting of tin, tantalum, and antimony in elementary form, said filling being free from iodine in an amount exceeding 0.5 μmol I/cm$^3$ of the discharge space.

14. A metal halide lamp according to claim 13, wherein said discharge electrodes comprise tungsten.

15. A metal halide lamp according to claim 13, wherein said discharge vessel emits radiation having a color temperature of 5000 K. or less.

16. A metal halide lamp according to claim 15, wherein said lamp has a life of greater than about 350 hours.

17. A metal halide lamp according to claim 13, wherein said lamp has a life of greater than about 350 hours.

* * * * *